US010220393B2

(12) United States Patent
Nilsson

(10) Patent No.: US 10,220,393 B2
(45) Date of Patent: Mar. 5, 2019

(54) METHOD FOR MANUFACTURING A SEPARATION DISC AND THE SEPARATION DISC

(71) Applicant: ALFA LAVAL CORPORATE AB, Lund (SE)

(72) Inventor: Sven-Åke Nilsson, Gnesta (SE)

(73) Assignee: ALFA LAVAL CORPORATE AB, Lund (SE)

( * ) Notice: Subject to any disclaimer, the term of this patent is extended or adjusted under 35 U.S.C. 154(b) by 249 days.

(21) Appl. No.: 15/102,208

(22) PCT Filed: Dec. 18, 2014

(86) PCT No.: PCT/EP2014/078546
§ 371 (c)(1),
(2) Date: Jun. 6, 2016

(87) PCT Pub. No.: WO2015/091846
PCT Pub. Date: Jun. 25, 2015

(65) Prior Publication Data

US 2016/0303579 A1 Oct. 20, 2016

(30) Foreign Application Priority Data

Dec. 20, 2013 (EP) ..... 13199075

(51) Int. Cl.
*B04B 1/08* (2006.01)
*B04B 7/14* (2006.01)
*B21D 22/16* (2006.01)

(52) U.S. Cl.
CPC ..... *B04B 7/14* (2013.01); *B04B 1/08* (2013.01); *B21D 22/16* (2013.01)

(58) Field of Classification Search
CPC ..... B04B 7/14; B04B 5/12; B04B 2005/125; B04B 1/08; B04B 1/04; B01D 45/14; B21D 22/16
(Continued)

(56) References Cited

U.S. PATENT DOCUMENTS 1,006,622 A 10/1911 Bailey
3,409,521 A 11/1968 Sharples
(Continued)

FOREIGN PATENT DOCUMENTS

CN 102266888 A 12/2011
CN 102430631 A 5/2012
(Continued)

*Primary Examiner* — Charles Cooley
(74) *Attorney, Agent, or Firm* — Birch, Stewart, Kolasch & Birch, LLP

(57) ABSTRACT

A method for manufacturing a separation disc, starting from a metal sheet blank with a top side and a bottom side, applying on said metal sheet blank extra metal material in positions on its top side, by means of welding, placing the metal sheet blank on a mandrel including a truncated conical support surface with recesses corresponding to spacing members on the completed separation disc, with the bottom side facing said truncated conical support surface, aligning the metal sheet blank so that the positions of the extra metal material after the pressing will correspond to the recesses, flow forming the metal sheet blank by means of a roller and the mandrel, the roller forming the separation disc over the mandrel completing a separation disc with spacing members on said bottom side. A separation disc for a centrifugal separator is made of a metal material and adapted to be compressed in a stack of separation discs inside a centrifugal rotor for separating a liquid or liquid/solid mixture. The separation disc has a truncated conical shape with an outer surface and an inner surface and a plurality of spacing members extending a certain height above the inner surface
(Continued)

for providing interspaces between mutually adjacent separation discs in said stack. The thickness of the separation disc and the height of the spacing members have a ratio of at least 1 to 1.

20 Claims, 2 Drawing Sheets

(58) Field of Classification Search
USPC ..... 494/68–73
See application file for complete search history.

(56) References Cited

U.S. PATENT DOCUMENTS 4,861,329 A * 8/1989 Borgstrom ..... B04B 1/08 494/73
5,477,021 A 12/1995 Kohlstette et al.
5,883,354 A * 3/1999 Elofson ..... B04B 7/14 219/117.1
9,914,138 B2 * 3/2018 Nilsson ..... B04B 7/14
2014/0148327 A1 * 5/2014 Nilsson ..... B21D 22/16 494/70
2016/0303579 A1 * 10/2016 Nilsson ..... B04B 7/14
2018/0141057 A1 * 5/2018 Hagqvist ..... B04B 1/08
2018/0147580 A1 * 5/2018 Nilsson ..... B21D 22/16

FOREIGN PATENT DOCUMENTS

CN 202239226 U 5/2012
DE 48615 7/1888
DE 557376 8/1932
DE 197 05 704 C1 7/1998
EP 2 556 895 A1 2/2013
EP 2556895 A1 * 2/2013
GB 21381 10/1912
JP 11-10244 A 1/1999
RU 2410184 C1 1/2011
SE 21700 7/1905
WO WO 2007/055630 A1 5/2007

* cited by examiner

METHOD FOR MANUFACTURING A SEPARATION DISC AND THE SEPARATION DISC

TECHNICAL FIELD

The invention concerns a method for manufacturing a separation disc, starting from a metal sheet blank with a top side and a bottom side. The invention also concerns a separation disc for a centrifugal separator, the separator disc being of a metal material and adapted to be compressed in a stack of separation discs inside a centrifugal rotor for separating a liquid or liquid/solid mixture, the separation disc having a truncated conical shape with an outer surface and an inner surface and a plurality of spacing members extending a certain height above the inner surface for providing interspaces between mutually adjacent separation discs in said stack. The invention also concerns a disc stack comprising a plurality of such separation discs as well as a separator comprising such a disc stack.

BACKGROUND OF THE INVENTION AND PRIOR ART

Conical separation discs have been known for more than 100 years (see for example DE 48615) and have been extensively used in many types of centrifugal separator. Despite it also being about 100 years since it was proposed to provide a separation disc with elevations formed integrally with it (see for example SE 21700 and U.S. Pat. No. 1,006,622), this technique is nevertheless not applied in practice when thin sheet metal is used as material for separation discs. In contrast, it has been extensively possible to produce separation discs made of plastic which are provided with integrally formed spacing means. This is easy to do, since separation discs made of plastic can be manufactured by injection moulding technology.

Separation discs made of thin sheet metal are usually produced by spinning and are provided with spacing means in the form of narrow strips or small circles of sheet metal which are fastened to the separation discs after the forming in various ways, usually by spot welding. An operation for attaching separate spacing means to separation discs, e.g. by welding, is both expensive and time-consuming.

A method for pressing separation discs with integrally formed elevations is referred to in DE 197 05 704, which involves flow forming of a sheet metal blank over a cone to produce a separation disc with integrally formed elevations. The sheet metal blank is pressed over the cone by means of roll. The cone is provided with depressions which during the flow forming of the sheet metal blank become filled with material from the blank.

In making separation discs with elevations according to the method referred to in DE 197 05 704, it may be difficult to achieve a separation disc on which the elevations exceed a certain height. Trying to achieve this may cause unduly stress on the material especially if the blanks are thin, because of the amount of material needed to fill the depressions on the pressure roll cone in relation to the "available" material of the blank or the material available is simply not enough to fill the depressions. This is especially the case if the ratio between the thickness of the separation disc and the height of the elevations or spacing members exceed 1 which is desired in some applications.

SUMMARY OF THE INVENTION

The object of the present invention is to provide a method for producing a separation disc of the kind indicated in the introduction with spacing members in the form of elevations of a substantial height even though the separation disc itself is thin.

This object is achieved according to the invention by applying on said metal sheet blank extra metal material in positions on its top side, by means of welding, placing the metal sheet blank on a mandrel comprising a truncated conical support surface with recesses corresponding to spacing members on the completed separation disc, with the said bottom side facing said truncated conical support surface, aligning the metal sheet blank so that the positions of the extra metal material after said pressing will correspond to said recesses, flow forming said metal sheet blank by means of a roller and said mandrel, the roller forming the separation disc over said mandrel completing a separation disc with spacing members on said bottom side.

According to an embodiment of the invention, the separation disc is manufactured by a method whereby the pressing is effected by said mandrel being provided with said recesses along said support surface and being arranged for rotation about a geometric axis of the conical support surface in order to form said separation disc, by said metal sheet blank being caused to abut firmly against said mandrel transversely to the geometric axis at one axial end of the conical support surface, by said mandrel and the metal sheet blank being caused to rotate at the same speed about the geometric axis, and by abutment being effected between said roller, which is rotatable about a central axis, and the side of the metal sheet blank which faces away from the support surface and is provided with said extra metal material, during the rotation of the mandrel and the metal sheet blank, whereby the roller is pressed against the metal sheet blank and is caused by friction to roll against the metal sheet blank, without accompanying the latter and the mandrel in their rotation, and is guided axially and in the circumferential direction along a helicoidal path along, but at a chosen distance from the support surface, so that the metal sheet blank is gradually moved along this helicoidal path to abut against the support surface, with such force that material from the metal sheet blank moves into said recesses in the support body.

The elevations or spacing members can thus be formed at substantially the same time as the metal sheet is pressed to abut against the support surface.

The extra material can be laser welded in long strips radially on the metal sheet blank or the strips may be inclined against a radius of the metal sheet blank.

Material may be removed from the top side of the metal sheet blank after the flow forming by cutting machining.

The invention also concerns a separation disc for a centrifugal separator previously mentioned, wherein the thickness of said disc and the height of said spacing members have a ratio of at least 1 to 1.0, 1 to 1.25, 1 to 1.5, 1 to 2, 1 to 2.5 or 1 to 3.

The invention also concerns a disc stack comprising a plurality of separation discs described above.

The invention also concerns a separator comprising a disc stack described above.

BRIEF DESCRIPTION OF THE DRAWINGS

The present invention is further described below with reference to the attached drawings, in which.

DETAILED DESCRIPTION OF VARIOUS EMBODIMENTS OF THE INVENTION

Figure 1:
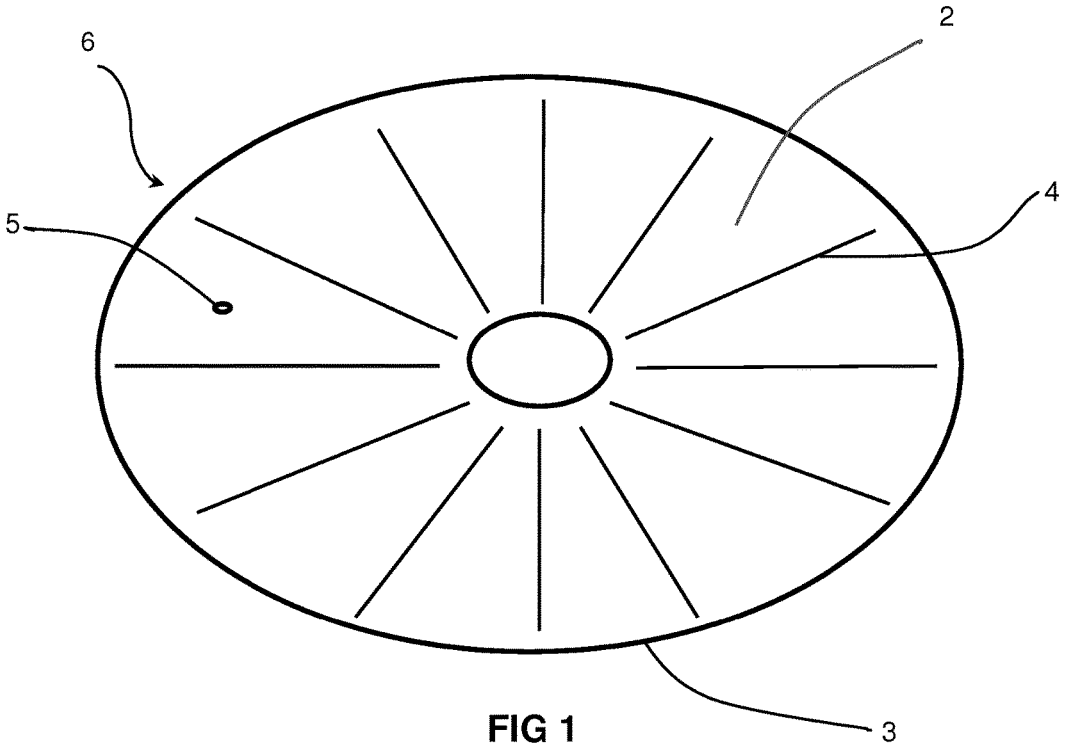
FIG. 1 depicts a metal sheet blank ready for flow forming.

FIG. 1 depicts a metal sheet blank 6 in the form of a circular metal sheet used for forming a conical separation disc 1. Before the metal sheet blank 6 is further processed and formed, extra material is applied on one side of the metal sheet by using welding, which hereinafter is called the top side 2. The metal sheet blank 6 also has a bottom side 3.

Examples of welding processes that may be used are arc welding, oxyfuel gas welding, resistance welding, solid-state welding, induction welding, laser welding such as laser beam welding and laser-hybrid welding, and electrogas welding.

The extra material is applied to the top side of the metal sheet blank 6 so that the metal sheet is formed corresponding to desired elevation height on its top side 2 which is the opposite side to where the finished projections, i. e. spacing members 4, 5 will be appearing. When applying the extra material allowance for the stretching of the material in the following flow forming procedure has to be made so that the placing of the extra material will correspond to positions, where the finished projections is desired. The extra material is in FIG. 1 arranged in long strips inclined against a radius of the metal sheet blank 6 but may instead be straight radial. The width of the spacing members may be as large as 5 mm depending on the dimension of the separation disc. Other configurations of the spacing members are possible.

If small-sized spacing members in large numbers are desired on the surfaces of the thin metal separation discs then equidistant spaces may be achieved using even thinner separation discs than today. Hence, the separating capacity of the centrifugal separator can in this way be further increased by fitting a greater number of the thinner metal separation discs into the stack and still maintain equidistant interspaces. The invention will in this way facilitate the use of separation discs as thin as possible to maximize the number of separation discs and interspaces within a given stack height. Furthermore, in particular in large size centrifugal separators, the separation discs can run the risk of touching each other in the compressed state. This is a further reason why there is a minimal height (size) on the interspaces (such as 0.4 mm) in order to secure that the discs are not completely compressed against each other.

It is possible, due to the small width of the spacing members (i.e. small-sized spacing members), to arrange a distribution pattern in the form of a cluster or concentration of said spacing members in specific surface areas of the separation disc, where the previously mentioned problem of compression arises in the assembled stack of separation discs.

The spacing members may also—as an alternative to the clustered configuration—be configured in an evenly distributed pattern (i.e. the same distance between mutually adjacent small-sized spacing members) throughout the surface of the separation disc, and possibly at a greater concentration compared to "conventional" (large-sized) spacing members.

Finding a suitable distribution pattern may not only depend on the separation disc itself, but also on the design of the centrifugal rotor and the way in which the stack of separation discs is compressed inside the rotor. The deformation of the interspaces in the compressed disc stack may be calculated/simulated in a computer, or by inspecting the actual compressed disc stack. Such inspection could for instance be conducted by making a cast of a compressed disc stack, whereby any suitable casting material is introduced into the compressed disc stack (constituting the mold) inside which the casting material is allowed to solidify. The deformation areas may thereafter be identified, whereby the surface of the separation disc can be configured with (further) small-sized spacing members in the identified areas. Hence, the small-sized spacing members are distributed in a pattern such that equidistant interspaces are obtained in the compressed disc stack.

The small-sized spacing spacing members may be distributed on the surface of the separation disc at a mutual distance in the range of 10-60 mm from each other.

The small-sized spacing members may have a width of 1 mm±0.5 mm, and preferably a width which is less than 1.5 mm, such as a width from 1 mm and smaller. Furthermore, these spacing members are preferably spot-formed, whereby the width of the spot-formed spacing member corresponds to its diameter. The spot-formed spacing members may be of either half-spherical or cylindrical shape as seen in the direction of its height. One advantage of the invention is that due to the smaller size, compared to the "conventional" large-sized spacing member, the spacing members may be provided in greater number without blocking the flow of liquid mixture. Furthermore, a greater number of small-sized spacing members may be arranged without reducing the effective separating area of the separation disc. It would however also be possible to provide small-sized spacing members of a somewhat elongated shape along the surface of the separation disc—even with lengths which are several times greater than said width of the spacing member. Such elongated spacing members must not be clustered too close together or oriented, in such a way that the liquid mixture is obstructed from flowing through the interspaces.

The spacing members may be integrally formed in one piece with the material of the separation disc. Accordingly, they may be formed in the material in accordance with the (previously mentioned) known techniques for manufacturing separation discs with integrally formed spacing members. The spacing members may be integrally formed by means of so called flow-forming, The small-sized spacing members in accordance with the invention provides an advantage in that only a small amount of the material of the separation disc needs to be displaced during this forming process. Hence, the volume of the displaced material in the integrally formed spacing member is very small, whereby the risk of producing an uneven surface (e.g. on the opposite side of the spacing member) is reduced. Furthermore, it's easier to displace a small amount of material, and thereby produce a more reliable form on the spacing members than with large-sized spacing members. For instance, a tool (or mandrel) used in the forming of the small-sized spacing members may be configured with only small-sized recesses (e.g. 1 mm±0.5 mm in width) into which the material of the separation disc is displaced, whereby a large number of exclusively small-sized spacing members is formed on the disc surface in a configuration to achieve the equidistant interspaces.

In a typical case the thickness of the blank may be $t_0$=0.5 mm and the desired elevation height of the spacing members may be h=0.7 mm. The thickness of the formed separation disc will then typically be $t_1$=0.32 mm. For thicker separation discs the height may be greater.

Separation discs for a centrifugal separator previously mentioned, wherein the thickness of said disc and the height of said spacing members have a ratio of at least 1 to 1.0, 1 to 1.25, 1 to 1.5, 1 to 2, 1 to 2.5 or 1 to 3 may be manufactured by the method herein described.

Figure 2:
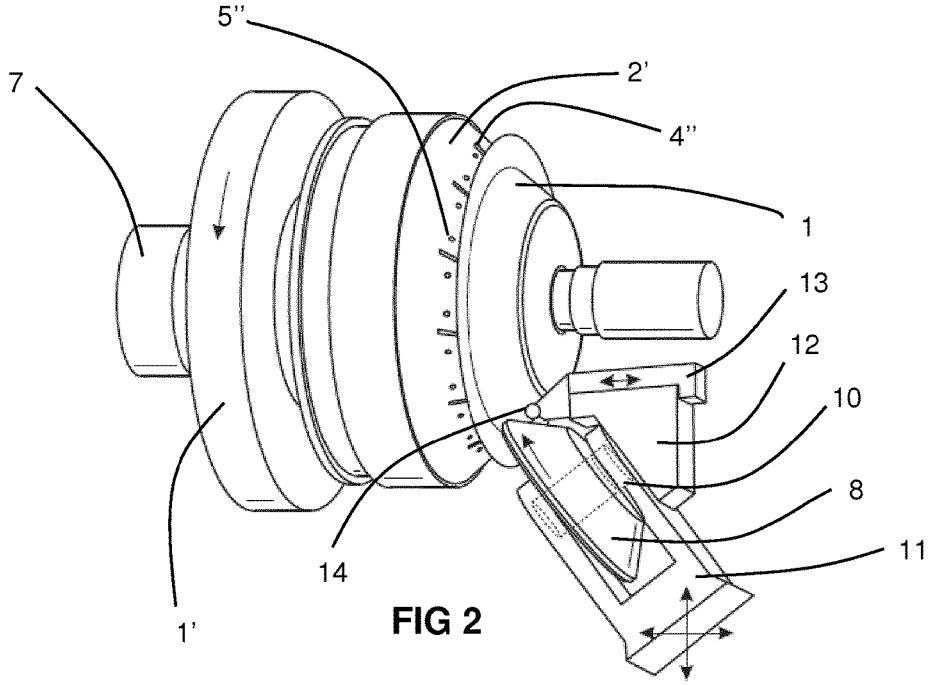
FIG. 2 depicts the main parts of a device for producing a conical separation disc using a metal sheet according to FIG. 1, by the method according to an embodiment of the invention.

The flow forming of the metal sheet blank 6 which now has extra material welded on one side of it is described in relation to FIG. 2 which depicts a device for producing a conical separation disc 1 made of thin sheet metal. The device comprises a truncated conical mandrel 1' with a conical support surface 2' which by means of a motor 7 is rotatable about its geometric axis X. In the example depicted, the geometric axis X is oriented horizontally, which is of course not necessarily the case. The mandrel 1' is provided on its conical support surface 2' with a plurality of elongate depressions or recesses 4" evenly distributed about the geometric axis X. Each recess 4" may, as depicted in FIG. 1, be straight and form an acute angle with such generatrices of the conical mandrel 1' as intersect it. If so desired, each of the grooves may be somewhat arcuate or straight and extend along a purely radial generatrix of the mandrel's 1' conical support surface 2'. Two circular recesses 5" are formed between two adjacent elongate recesses 4". The recesses 4" have to be of a depth corresponding to the intended distance between two adjacent separation discs fitted in a centrifugal separator.

An initially planar circular metal sheet blank 6 is fastened to the apex end of the mandrel 1', coaxially with the support surface, by a retainer 11. Engagement means (not depicted) of both the mandrel 1' and the metal sheet blank 6 ensure that the metal sheet blank 6 accompanies the rotation of the mandrel 1' during the operation which will be described later on.

A rotatable press element or roller 8 disposed at an axial level close to the apex end of the support surface 2' at a radial distance from the central axis X takes the form of a rotation body and is rotatable about a central axis Y. In the example depicted in FIG. 2, the central axis Y, which extends at an angle relative to the geometric axis X of the conical support surface 2', is situated vertically below the geometric axis X. The invention is of course not limited to this orientation and positioning.

The roller 8 is supported by a shaft 10 which is itself supported for rotation by a retainer 11. The retainer 11 is movable vertically and horizontally by means of a motor (not depicted), as indicated by two arrows pointing respectively upwards and downwards and two arrows pointing respectively left and right. The means for moving the roller 8 vertically and horizontally and guiding the position of the roller 8 relative to the support surface 2' may take many different forms which are well known in the field of sheet metal form flowing and pressure turning and are therefore not described in more detail.

Ordinarily in this described process further processing after the form flowing step to make the separation disc thinner is not required. However if this is required or the top side 2 of the metal sheet blank needs to be smoothened material may be removed from the top side 2 surface which has been subject to pressing. As a further embodiment the metal sheet blank may thus be processed by pressure turning. A further second retainer 12 may thus be arranged on the retainer 11 as in FIG. 2. The second retainer 12 supports a tool 13 comprising a cutter 14. The tool 13 is movable as indicated by two arrows pointing respectively left and right relative to the retainer 12 so that the position of the cutter 14 relative to the surface of the metal sheet blank can be set in such a way as to achieve a desired cutting depth for the material-removing machining.

The device according to FIG. 2 works as follows: The motor 7 causes the mandrel 1' and the metal sheet blank 6 applied firmly to the latter to rotate about the axis X. Thereafter the roller 8 is moved by the retainer 11 and the associated motor to contact with the metal sheet blank 6 from the right with respect to FIG. 2. This contact has to occur at the radial distance from the geometric axis X at which the metal sheet blank 6 is in contact with the radially innermost part of the conical support surface 2' of the mandrel 1'. Thereafter the roller 8 is pressed axially against the metal sheet blank 6 at a desired radial distance from the conical support surface 2' along a generatrix of the support surface 2', so that its shape is adapted to the shape of the mandrel 1'. At this stage, the roller 8 will be caused by friction to roll against the metal sheet blank 6 and hence to rotate about its central axis Y without accompanying the mandrel 1' and the metal sheet blank 6 in their rotation. The rotation movements of the mandrel 1' and the roller 8 are represented by two arrows in FIG. 2. The retainer 11 and said motor proceed to press the roller 8 with great force axially and radially against the metal sheet blank 6, thereby form flowing the latter to the same conical shape as the mandrel 1'.

During the flow forming process the material is stretched and the metal sheet gets thinner. This means that the positions of the extra material is displaced along the circumferential. The displacement depends on the force of the roller 8 on the metal sheet blank 6 and the required displacement in each case may be determined experimentally. The position where the extra material should be applied may thus be determined.

When the form flowing has proceeded so far axially that the metal sheet blank 6 has reached the recesses 4", 5" in the mandrel 1', the roller 8 will, during the pressing, push material from the metal sheet blank 6 down into these recesses 4", 5". As the extra material has been applied in positions on the metal sheet blank corresponding to said displacement, the extra material will help filling the recesses 4", 5".

Figure 3:
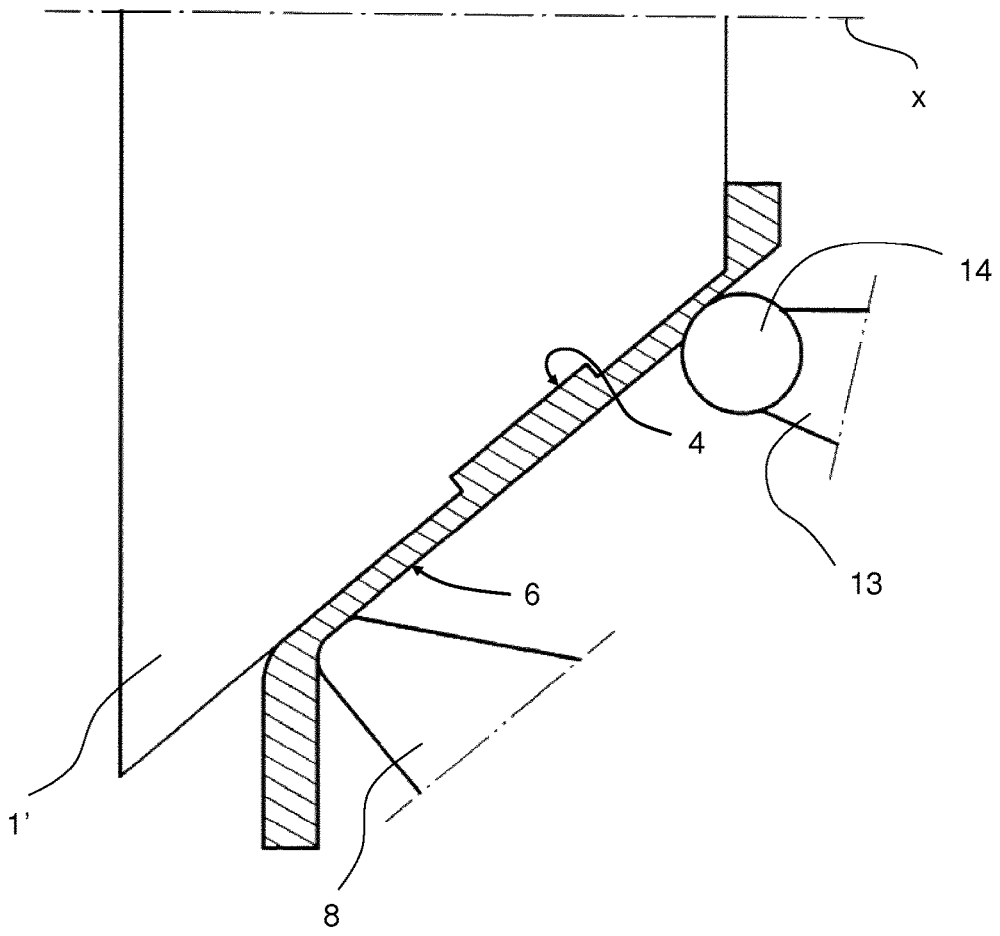
FIG. 3 depicts a cross-section through parts of a device comprising a support body with recesses, a press element for forming a metal sheet with elevations, and a tool for material-removing machining, for producing a separation disc in accordance with a further embodiment of the invention.

If an even thinner disc is required the second retainer previously described may be used. The retainer 12 will also gradually bring the cutter 14 on the tool 13 to engage with the metal sheet blank 6. During the continuing rotation of the metal sheet blank 6, the cutter 14 will remove material from the conical surface of the metal sheet blank 6, resulting in a smooth surface without unevennesses. This is also depicted in FIG. 3. The movement of the roller 8 and the tool 13 relative to the mandrel 1' and the engagement depth of the cutter 14 in the metal sheet blank 6 may be controlled by computer technology or in some other suitable way which is well known in relation to flow forming and/or cutting by pressure turning and material-removing machining.

The invention claimed is:

1. A method for manufacturing a separation disc, comprising the steps of:

starting from a metal sheet blank with a top side and a bottom side, welding extra metal material on said metal sheet blank at positions on the top side of said metal sheet blank;

placing the metal sheet blank on a mandrel comprising a truncated conical support surface with recesses corresponding to spacing members on the completed separation disc, with the bottom side of the metal sheet blank facing said truncated conical support surface;

aligning the metal sheet blank so that the positions of the extra metal material after pressing will correspond to said recesses; and flow forming said metal sheet blank by means of a roller and said mandrel, wherein the roller forms the separation disc over said mandrel to complete a separation disc with spacing members on said bottom side.

2. The method according to claim 1, wherein the flow forming is effected:

by said mandrel being provided with said recesses along said truncated conical support surface and being arranged for rotation about a geometric axis of the truncated conical support surface in order to form said separation disc;

by said metal sheet being caused to abut firmly against said mandrel transversely to the geometric axis at one axial end of the truncated conical support surface;

by said mandrel and the metal sheet blank being caused to rotate at the same speed about the geometric axis; and by abutment being effected between said roller, which is rotatable about a central axis, and the side of the metal sheet blank which faces away from the truncated conical support surface and is provided with said extra metal material, during the rotation of the mandrel and the metal sheet blank, whereby the roller is pressed against the metal sheet blank and is caused by friction to roll against the metal sheet blank, without accompanying the latter and the mandrel in their rotation, and is guided axially and in the circumferential direction along a helicoidal path along, but at a chosen distance from the truncated conical support surface, so that the metal sheet blank is gradually moved along this helicoidal path to abut against the truncated conical support surface, with such force that material from the metal sheet blank moves into said recesses in the mandrel.

3. The method according to claim 2, wherein the extra metal material is laser welded in long strips radially on the metal sheet blank.

4. The method according to claim 2, wherein the extra metal material is laser welded in long strips inclined against a radius of the metal sheet blank.

5. The method according to claim 2, where material is removed from the top side of the metal sheet blank after the flow forming by cutting machining.

6. The method according to claim 2, where said extra metal material is applied by means of laser welding.

7. The method according to claim 1, wherein the extra metal material is laser welded in long strips radially on the metal sheet blank.

8. The method according to claim 1, wherein the extra metal material is laser welded in long strips inclined against a radius of the metal sheet blank.

9. The method according to claim 1, where material is removed from the top side of the metal sheet blank after the flow forming by cutting machining.

10. The method according to claim 1, where said extra metal material is applied by means of laser welding.

11. A separation disc for a centrifugal separator, the separator disc being of a metal material and adapted to be compressed in a stack of separation discs inside a centrifugal rotor for separating a liquid or liquid/solid mixture, the separation disc comprising:

a truncated conical shape with an outer surface and an inner surface and a plurality of spacing members extending a certain height above the inner surface for providing interspaces between mutually adjacent separation discs in said stack, the spacing members being spaced from each other in a circumferential direction; and strips of material applied to the outer surface at locations corresponding to the spacing members, that are formed into the disc by a forming operation to generate each of said spacing members.

12. The separation disc according to claim 11, wherein a thickness of said separation disc and a height of said spacing members have a ratio of at least 1 to 1.25.

13. The separation disc according to claim 11, wherein a thickness of said separation disc and a height of said spacing members have a ratio of at least 1 to 1.5.

14. The separation disc according to claim 11, wherein a thickness of said separation disc and a height of said spacing members have a ratio of at least 1 to 2.

15. The separation disc according to claim 11, wherein a thickness of said separation disc and a height of said spacing members have a ratio of at least 1 to 2.5.

16. The separation disc according to claim 11, wherein a thickness of said separation disc and a height of said spacing members have a ratio of at least 1 to 3.

17. A disc stack comprising a plurality of separation discs according to claim 11.

18. A separator comprising the disc stack according to claim 17.

19. The separation disc according to claim 11, wherein the strips of material are welded and compressed to the outer surface.

20. The separation disc according to claim 11, wherein, after said forming operation, the outer surface is smooth without unevenness.

* * * * *